US010506354B2

(12) United States Patent
Petersen et al.

(10) Patent No.: US 10,506,354 B2
(45) **Date of Patent: *Dec. 10, 2019**

(54) FILTER MEMBER

(71) Applicant: Oticon A/S, Smørum (DK)

(72) Inventors: Svend Oscar Petersen, Smørum (DK); Morten Friis Karlsen, Smørum (DK); Martin Lindebjerg, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/138,463

(22) Filed: Sep. 21, 2018

(65) Prior Publication Data

US 2019/0028822 A1 Jan. 24, 2019

Related U.S. Application Data

(60) Continuation of application No. 15/639,068, filed on Jun. 30, 2017, now Pat. No. 10,129,670, which is a division of application No. 15/090,104, filed on Apr. 4, 2016, now Pat. No. 9,832,580, which is a division of application No. 14/457,623, filed on Aug. 12, 2014, now Pat. No. 9,332,361.

(30) Foreign Application Priority Data

Sep. 16, 2013 (EP) ..... 13184541

(51) Int. Cl.
*H04R 25/00* (2006.01)

(52) U.S. Cl.
CPC ..... *H04R 25/654* (2013.01); *H04R 25/60* (2013.01); *H04R 2225/025* (2013.01)

(58) Field of Classification Search
CPC .... H04R 25/608; H04R 25/654; H04R 25/60; H04R 2225/025
See application file for complete search history.

(56) References Cited

U.S. PATENT DOCUMENTS

| | | | | |
|---|---|---|---|---|
| 4,870,689 | A | 9/1989 | Weiss | |
| 4,972,488 | A * | 11/1990 | Weiss | H04R 25/654 381/322 |
| 6,595,317 | B1 * | 7/2003 | Widmer | H04R 25/652 181/135 |
| 6,671,381 | B1 | 12/2003 | Lux-Wellenhof | |
| 7,551,747 | B2 | 6/2009 | Huynh et al. | |
| 2010/0322452 | A1 * | 12/2010 | Ladabaum | H04R 25/656 381/375 |
| 2011/0096948 | A1 | 4/2011 | Rasmussen et al. | |
| 2012/0082336 | A1 | 4/2012 | Wubker et al. | |
| 2012/0250923 | A1 | 10/2012 | Beck et al. | |
| 2013/0129127 | A1 * | 5/2013 | Wagner | H04R 25/602 381/323 |

FOREIGN PATENT DOCUMENTS

WO WO 2008/025355 A1 3/2008

* cited by examiner

*Primary Examiner* — Tuan D Nguyen
(74) *Attorney, Agent, or Firm* — Birch, Stewart, Kolasch & Birch, LLP

(57) ABSTRACT

A replaceable filter member for a hearing aid device is disclosed. The filter member comprising an unit with a housing configured to be inserted into the ear canal of a user of the hearing aid device. The filter member is configured to prevent ear wax from entering an opening in the housing. The filter member is a one-piece body that is configured to cover several openings in the unit while being attached to the unit.

15 Claims, 5 Drawing Sheets

FILTER MEMBER

CROSS-REFERENCE TO RELATED APPLICATION

This application is a Continuation of copending U.S. application Ser. No. 15/639,068, filed on Jun. 30, 2017, which is a Division of U.S. application Ser. No. 15/090,104, filed on Apr. 4, 2016 (now U.S. Pat. No. 9,832,580, issued on Nov. 28, 2017), which is a Divisional of application Ser. No. 14/457,623, filed on Aug. 12, 2014 (now U.S. Pat. No. 9,332,361, issued on May 3, 2016). This application claims priority of application Ser. No. 13/184,541.4, filed in Europe on Sep. 16, 2013 under 35 U.S.C. § 119, all of which are hereby expressly incorporated by reference into the present application.

FIELD OF INVENTION

The present invention generally relates to preventing ear wax form interfering with the operation of an in-the-ear (ITE), an in-the-canal (ITC) or a receiver-in-the-ear (RITE) hearing aid device or hearing instruments comprising an ITE, ITC or RITE member to be placed in the ear canal. The invention more particularly related to a filter member for providing ear wax protection in an ITE, ITC or RITE hearing aid device or in a hearing instrument comprising an ITE, ITC or RITE member.

PRIOR ART

The outer ear of the human comprises an ear canal having generally oval cross section. Cerumen which is also referred to as ear wax is secreted by the wall of the ear canal. Accordingly, when a hearing aid device or parts hereof is inserted into the ear canal, the device or parts hereof are susceptible to ear wax that may mix with sloughed off skin and reduced the efficiency of the hearing aid device or the parts hereof when entering openings in the device or parts hereof.

Several approached have been made to protect ITE, ICT and RITE hearing aid devices against ear wax. One common way of preventing ear wax from damaging that part of the hearing aid device that is inserted in the ear canal, is to provide the device with an ear wax filter.

Some of the ear wax filters require specific tools to be changed. Moreover, the filters are small and needs to be produced in a manner in which small tolerance requirements can be met.

Thus, there is need for an alternative replaceable filter member that reduces or even eliminates these drawbacks of the prior art.

It is an object of the present invention to provide an ear wax protection filter member that is easy to change and user friendly.

SUMMARY OF THE INVENTION

The objects of the present invention can be achieved by a filter member as defined in claim 1. Preferred embodiments are defined in the dependent sub claims and explained in the following description and illustrated in the accompanying drawings.

The filter member according to the invention is a replaceable filter member for a hearing aid device comprising a unit with a housing configured to be inserted into the ear canal of a user of the hearing aid device, which filter member is configured to prevent ear wax from entering an opening in the housing. The filter member is a one-piece body that is configured to cover several openings in the unit while being attached to the unit.

Hereby it is achieved that only one filter member is required to cover the openings in the housing and thus protect the openings against ear wax. The filter member may be changed on a regular (daily) basis in order to maintain a well-functioning hearing aid device.

The term "replaceable" filter member refers to a filter member that is configured to be replaced with a new filter member e.g. with regular intervals (such as once a day or once every second day by way of example).

The "hearing aid device" may be any device, such as e.g. a hearing aid, a listening device or an active ear-protection device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. The "hearing aid device" further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears.

The "unit" may be a speaker unit of a RITE hearing aid device, an ITE hearing aid devise or an ITC hearing aid device or another device capable of providing an acoustic signal while being arranged within the ear canal of a user.

The housing of the unit may have any shape as long as the housing is suitable for being inserted into the ear canal of a user of the hearing aid device. The housing may be cylindrical, conical of box-shaped by way of example.

The filter member is configured to prevent ear wax from entering an opening in the housing. By the term "opening in the housing" is meant openings such as ventilation openings and sound openings allowing an acoustic signal to be transferred from the unit towards the eardrum. Further, openings such as microphone inlets, provided to channel sound from surroundings and into microphones are also comprised by the term "opening in the housing".

Although the filter member is a one-piece body, the filter member may comprise several parts and/or sections.

It may be an advantage that the filter member is a one-piece body that is configured to cover all openings in the unit while being attached to the unit. Hereby it is achieved that a full protection against ear wax can be provided by using a single filter member according to the invention. Such a filter member is particularly advantageous in case the in the ear device comprises a multitude of openings. This could be the following openings: sound output opening, vent channel openings, 1, 2 or more microphone inlet openings.

It may be beneficial that the filter member comprises a sock-like member configured to be attached to the housing. Such construction is easy to attach and user friendly. Besides, a filter member comprising a sock-like member is suitable for being detached from the housing in an easy way. It may be preferred that the filter member comprises a tight-fitting sock-like member.

It may be beneficial that the filter member comprises a flexible member. The flexible member may be an elastic structure that makes it possible to attach the filter member to the housing of the unit by means of the radial directed forces caused by the radial expansion of the elastic structures of the filter member during attachment to the housing. The flexible member may be a separate structure or a structure integrated in the remaining part of the filter member.

The flexible member may be produced on a felting, weaving, knitting or lacemaking machine of the type well known in the textile industry. This allows for a sock like structure which has an overall shape commensurate with the housing. Also it allows for differences in texture and knitting or weaving patterns being used at different surface parts of the sock like structure. Especially where the sock like structure is to cover openings, thicker, denser or thinner more openly knitted or woven structures may be easily provided. It is to be understood that woven or knitted structures encompasses structures generated by any crafting utilizing thread or yarn as the raw material, such as a bobbin machine.

It may be an advantage that the flexible member is configured to allow for attachment of the filter member to the unit and to allow for detachment of the filter member from the unit.

It may be advantageous that the filter member comprises an attachment member or a holding member configured to be attached to the housing of the unit and hereby provide a detachable attachment of the filter member to the unit. Hereby the attachment member or the holding member can be used to secure the filter member to the housing. This attachment member may be added to the woven or knitted structure or an integral part thereof.

It may be an advantage that the attachment member or the holding member comprises a ring that is configured to surround a portion of the housing of the unit. Hereby a simple and reliable way of securing the attachment member or the holding member to the housing can be achieved.

It may be advantageous that the attachment member or the holding member is configured to be attached to the proximal end of the housing of the unit and hereby provide a detachable attachment of the filter member to the unit.

In this way it is possible to use a filter member that covers the distal end of the housing and that extends along at least a portion of the length of the housing. Accordingly, the filter member can be firmly secured to the proximal end of the housing of the unit.

It may be an advantage that the filter member comprises a cover member configured to be attached to the housing of the unit and hereby provide a detachably attachment of the filter member to the unit.

The use of a cover member makes it possible to apply a simple filter member. Since the cover member can be attached to the housing of the unit, the filter member can be secured to the housing of the unit by means of the cover member. A use of a cover member may also ease the filter member replacement process, including attachment and detachment of the filter member.

It may be beneficial that the cover member comprises a base member that extends essentially parallel to the longitudinal axis of the housing and that one or more openings are provided in the base member so that the openings allow for sound propagation or ventilation through the openings.

A cover member of this construction provides the required radial support towards the filter member while being positioned along the length of the housing of the unit. The openings in the cover member secures that sound propagation or ventilation can take place by use of the microphone or ventilation openings in the housing of the unit.

It is preferred that the openings are provided so that the ventilation or microphone openings in the housing of the speaker unit base member are ventilated when the cover member is attached to the housing of the unit.

It may be advantageous that the filter member comprises a first lattice and a second lattice of different structure than the first lattice.

The use of different types of lattice makes it possible to provide a filter member that is suitable for dealing with different requirements at different positions on the housing.

It may be beneficial that the first lattice is arranged in such a way that it covers one or more microphone or ventilation openings in the housing of the unit and that the second lattice covers a sound opening in the distal end of the housing when the filter member is attached to the unit.

It may be an advantage that the first lattice is a fine mesh lattice and that the second lattice is more big-meshed.

It may be beneficial that the filter member comprises a closed end and an open end and that means for attaching the filter member to the housing is attached to the open end of the filter member. Hereby a simple, reliable and user-friendly filter member can be achieved.

It may be an advantage that the filter member comprises several sections of different structure. The different structures may be intended to meet different requirements at different positions of the housing of the unit.

It may be an advantage that the filter member is configured to be attached to means for attaching the filter member to the housing of the unit so that the means for attaching the filter member to the housing of the unit can be reused when the filter member is replaced by a new filter member. Such construction allows for reusing the part that is responsible for the attachment of the filter member to the housing. Hereby a filter member of minimum size can be used.

DESCRIPTION OF THE DRAWINGS

The invention will become more fully understood from the detailed description given herein below. The accompanying drawings are given by way of illustration only, and thus, they are not limitative of the present invention. In the accompanying drawings:

FIG. 1 *b*) shows a schematic side view of the speaker unit shown in FIG. 1 *a*) covered by the filter unit shown in FIG. 1 *a*);

FIG. 1 *c*) shows a schematic side view of the speaker unit shown in FIG. 1 *b*) having a dome attached to it;

FIG. 2 *b*) shows a schematic view of a filter member according to the invention attached to a speaker unit of a hearing aid device;

FIG. 2 *c*) shows a schematic view of a dome being attached to the speaker unit shown in FIG. 2 *b*);

FIG. 3 *b*) shows a schematic perspective view of the filter member shown in FIG. 3 *a*) being attached to the RITE hearing aid device shown in FIG. 3 *a*);

FIG. 4 *b*) shows a schematic perspective view of the filter member shown In FIG. 4 *a*) being attached to the speaker unit of the RITE hearing aid device shown in FIG. 3 *a*);

DETAILED DESCRIPTION OF THE INVENTION

Figure 1A:
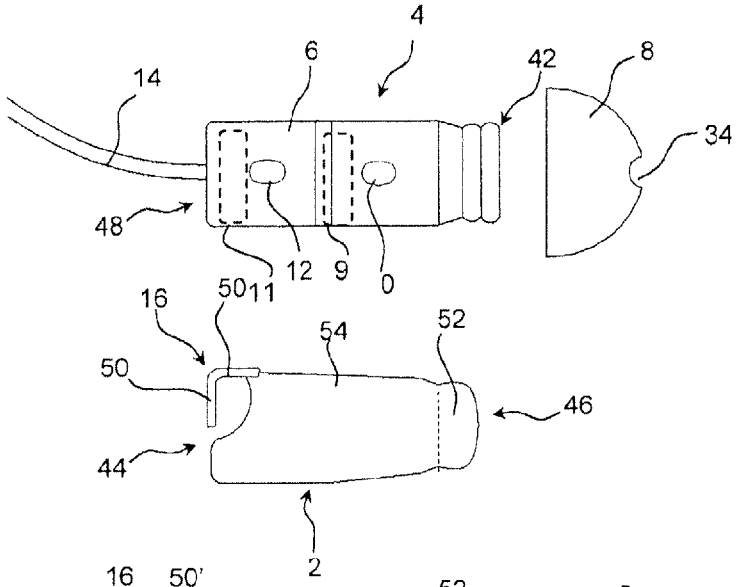
FIG. 1 *a*) shows a schematic side view of a filter member according to the invention arranged next to a speaker unit of a hearing aid device.
Figure 1B:
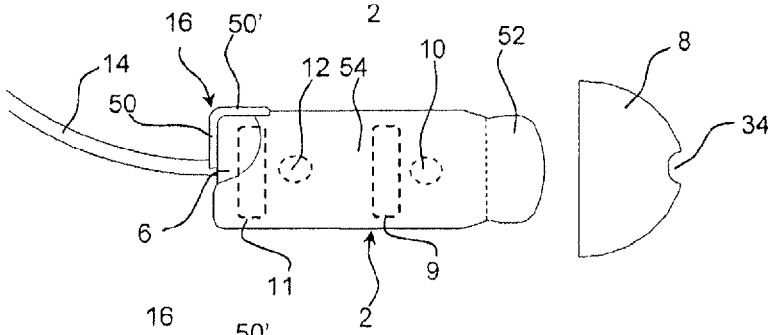
Figure 1C:
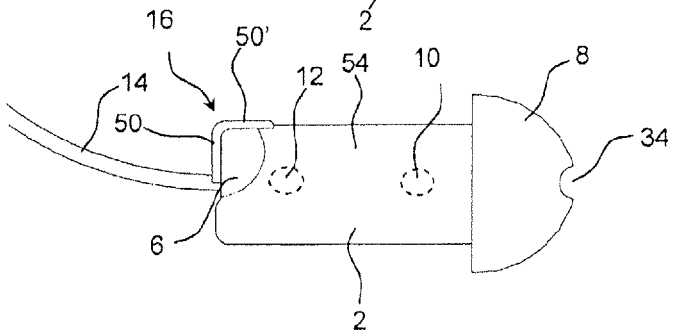

Referring now in detail to the drawings for the purpose of illustrating preferred embodiments of the present invention, different views of a filter member 2 according to the invention is illustrated in FIG. 1.

FIG. 1 *a*) illustrates a schematically side view of a filter member 2 according to the invention arranged next to a speaker unit 4 of a hearing aid device.

The speaker unit 4 comprises a basically cylindrical housing 6 provided with a first microphone or ventilation opening 10 and a second microphone or ventilation opening 12. The microphone or ventilation openings may be part of a vent system or they may form part of a microphone inlet system for a number of microphones 9,11 as indicated with a dashed line in FIG. 1*b*. Thus "speaker unit" designates a unit comprising at least a speaker, and possibly one or more microphones having each their sound or ventilation opening. The microphones 9, 11 may be part of the in the ear device in any of the other figures, even if it is not shown. A dome 8 is arranged next to the distal end 42 of the speaker unit 4. A centrally arranged sound outlet 34 is provided at the periphery of the dome 8. A tube 14 is provided in the proximal end 48 of the speaker unit 4, and inside the tube 14 leads (not shown) are provided which connects microphones and receiver or speaker to a sound processor placed elsewhere such as in a BTE unit.

A filter member 2 is arranged adjacent to the speaker unit 4. The filter member 2 is basically shaped as a sock. The filter member 2 has a closed end 46 configured to cover the distal end 42 of the speaker unit 4 and an open end 44 positioned in the opposite end of the filter member 2.

A holding member 16 having two legs 50, 50' constituting a right angle is provided at the open end 44 of the speaker unit 4. The filter member 2 is attached to the second leg 50', while the first leg 50 is configured to bear against the proximal end 48 of the speaker unit 4 while being attached to the housing 6 of the speaker unit 4.

The filter member 2 comprises a first structure 52 that is configured to cover the distal end 42 of the speaker unit 4. The filter member 2 comprises a second structure 54 that is configured to cover the majority of the remaining portion of the speaker unit 4. The second structure 54 covers the first microphone or ventilation opening 10 as well as the second microphone or ventilation opening 12 of the speaker unit 4.

The first structure 52 and the second structure 54 may be different from one another. In one embodiment of a filter member according to the invention the first structure 52 is configured to protect ear wax from damaging the speaker unit by entering through the sound outlet 34 in the dome 8. The first structure may comprise a rather coarse lattice structure (big-meshed).

The second structure 54 is preferably configured to provide an optimum protection against ear wax from entering and clogging the microphone or ventilation openings 10, 12 in the speaker unit. The first structure 52 may comprise a coarse and big-meshed lattice structure while the second structure 54 may comprise a fine mesh lattice structure.

The first structure 52 and the structure 54 of the filter member 4 may comprise an elastic member so that the filter member 2 is tight-fitting while being attached to the housing of the unit. The filter member 2 may be made in an elastic material or a material comprising elastic portions.

FIG. 1 *b*) illustrates schematically a side view of the speaker unit 4 shown in FIG. 1 *a*) covered by the filter member 2 shown in FIG. 1 *a*). It can be seen that the legs 50, 50' of the holding member 16 secure the holding member 16 and hence the filter member 2 to the housing 6 of the speaker unit 4.

The first microphone or ventilation opening 10 as well as the second microphone or ventilation opening 12 are covered by the filter member 2, however the first microphone or ventilation opening 10 and the second microphone or ventilation opening 12 are indicated with a dotted line for illustration purposes only.

The filter member 2 is configured to protect ear wax from entering the openings in the housing 6 of the speaker unit 4 including the first microphone or ventilation opening 10 and the second microphone or ventilation opening 12.

The filter member 2 is easy to attach to the housing 6 of the speaker unit 4 and it is possible and advantageous to change the filter member 2 regularly, e.g. on a daily basis, simply by replacing a used filter member 2 by a new one. The filter member 2 prevents ear wax accumulation.

Next to the housing 6 of the speaker unit 4 a dome 8 is shown.

In FIG. 1 *c*) the dome 8 is attached to the distal end of the housing 6 of the speaker unit 4. The speaker unit 4 is configured to receive the dome 8 while the housing 4 of the speaker unit 4 is covered by the filter member 2.

When the filter member 2 and the dome 8 is attached to the speaker unit 4, like illustrated in FIG. 1 *c*), the speaker unit 4 is ready for being placed in the ear canal of the user of the hearing aid device.

Figure 2A:
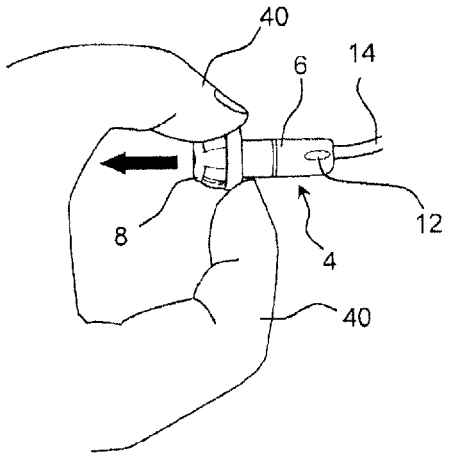
FIG. 2 *a*) shows a schematic view of a dome being detached from a speaker unit of a hearing aid device.
Figure 2B:
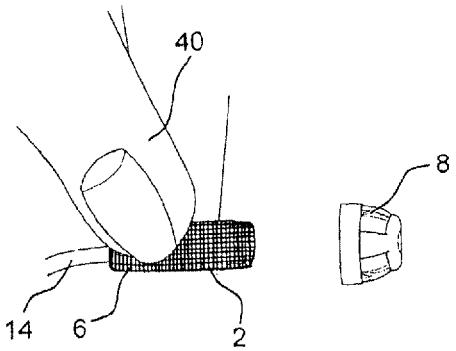
Figure 2C:
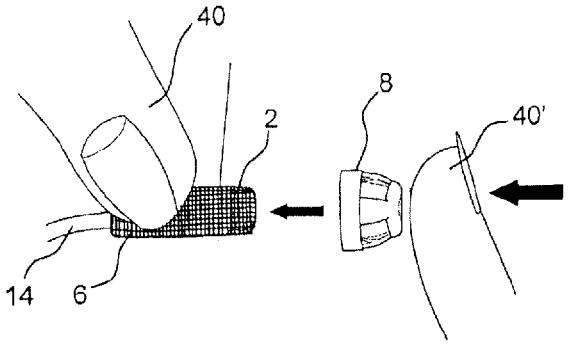

FIG. 2 *a*) illustrates a schematically view of a dome 8 being detached from a speaker unit 4 of a hearing aid device. The speaker unit 4 comprises an elongated basically cylindrical housing 6 provided with a microphone or ventilation opening 12 and connected to a tube 14. The user of the hearing aid device uses two fingers 40 to grip against the dome 8 in order to pull it off the distal end of the housing 6 of the speaker unit 4.

In FIG. 2 *b*) the dome 8 has been removed from the housing 6 of the speaker unit 4. Besides a filter member 2 according to the invention has been attached to the housing 6 of the speaker unit 4. The filter member 2 covers the microphone or ventilation opening 12 (visible in FIG. 1 *a*)) as well as the opening (not shown) in the distal end of the housing 6 of the speaker unit 4. The user is holding the housing 6 of the speaker unit 4 with two fingers 40.

In FIG. 2 *c*) a dome 8 is being attached to the housing 6 of the speaker unit 4. The attachment of the dome 8 is carried out by pushing the dome 8 into firm mechanical engagement with the distal end of the housing 6 of the speaker unit 4. The distal end of the housing 6 of the speaker unit 4 is configured to receive the dome 8. The user applies a finger 40' from the other hand to push the dome in engagement with the distal portion of the housing 6 of the speaker unit 4.

Figure 3:
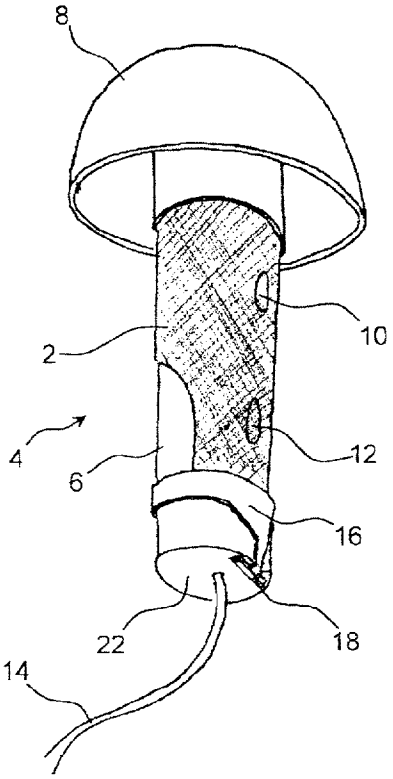
FIG. 3 *a*) shows a schematic perspective view of a filter member according to the invention being attached to a RITE hearing aid device.
Figure 3:
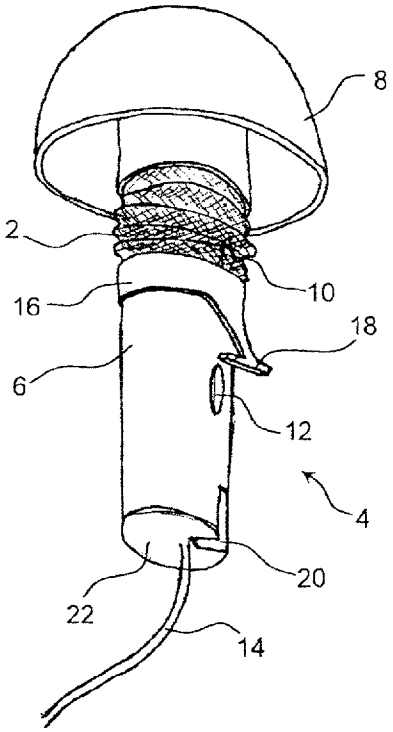

FIG. 3 *a*) illustrates schematically a perspective view of another filter member 2 according to the invention. The filter member 2 is being attached to a RITE hearing aid device comprising a speaker unit 4 having a housing 6. The housing 6 is basically cylindrical and has a plane circular bottom surface 22 provided with a recess 20 extending along a minor portion of the length of the housing 6.

A microphone or ventilation opening 12 is provided in the housing and a tube 14 enters the bottom surface 22 of the housing 6 and is hereby connected to the speaker unit 4. A dome 8 is attached to the distal end of the housing 6 and a filter member 2 shaped a flexible sock covers and is attached to the distal portion of the housing 6 of the speaker unit 4.

A basically ring-shaped holding member 16 is attached to the distal end of the filter member 2 and the holding member 16 surrounds the housing 6 of the speaker unit 4. The holding member 16 is provided with a gripping member 18 configured to be fixed to the housing 6 of the speaker unit 4 by placing the gripping member 18 in the recess 20.

In FIG. 3 *b*) the filter member 2 has been attached to the housing 6 of the speaker unit 4. The gripping member 18 of the holding member 16 is fixed in the recess 20 of the housing 6 of the speaker unit 4.

It can be seen that the filter member 2 covers the first microphone or ventilation opening 10 as well as the second microphone or ventilation opening 12 in the housing 6 of the speaker unit 4. However, a minor portion of the housing 6 is not covered by the filter member 2.

It is possible to apply other means for attaching the filter member 2 to the housing 6 of the speaker unit 4. However, the shown holding member 16 is easy to use and reliable since it is secured to the housing 6 because the holding member 16 surrounds the housing and is attached to the housing 6.

Figure 4B:
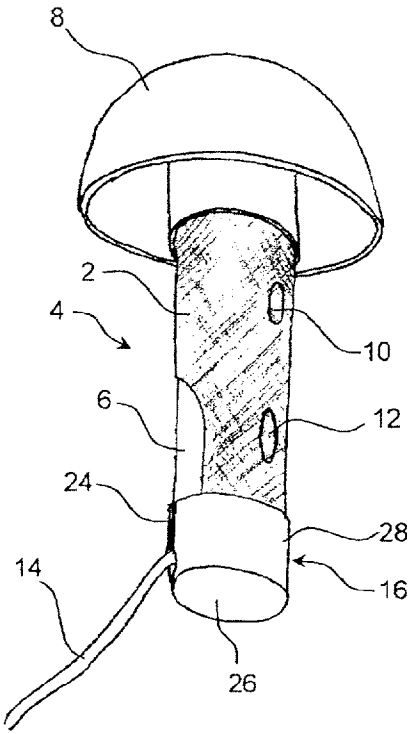
FIG. 4 *a*) shows a schematic perspective view of a filter member according to the invention being attached to a speaker unit of a RITE hearing aid device.
Figure 4A:
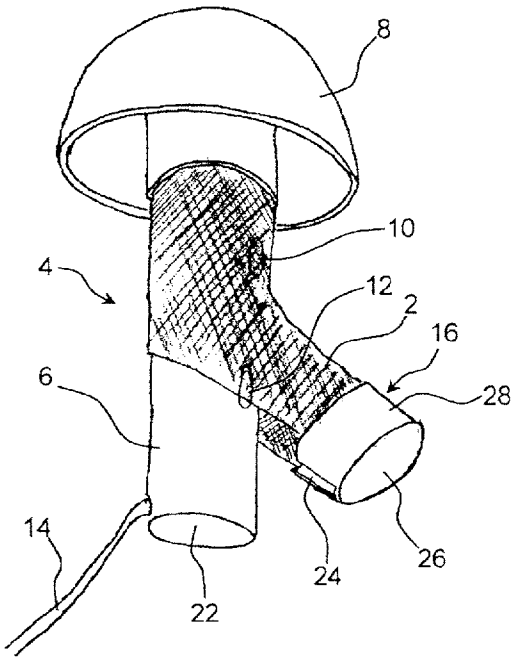

FIG. 4 *a*) illustrates a schematically perspective view of a filter member 2 according to the invention being attached to the speaker unit 4 of a RITE hearing aid device. The filter member 2 is being attached to the housing 6 of the speaker unit 4 of the RITE hearing aid device.

The housing 6 has a basically cylindrical structure and a plane essentially circular bottom surface 22. A tube 14 enters the housing 6 near the bottom surface 22. A dome 8 is attached to the housing 6 of the speaker unit 4.

The filter member 2 comprises a bucket-shaped holding member 16 having a plane bottom member 26 and an essentially cylindrical side member 28 extending from the periphery of the bottom member 26. An aperture 24 is provided in the side member 28 of the holding member 16. The aperture 24 is configured to give room for the tube 14 to extend radially and axially from the housing 6 (see FIG. 4 *b*).

The filter member 2 covers a first microphone or ventilation opening 10 of the housing 6 while the second opening 12 is intended to be covered by the filter member 2 when the filter member 2 is attached to the housing (see FIG. 4 *b*).

FIG. 4 *b*) illustrates a schematically perspective view of the speaker unit 4 and the filter member 2 shown in FIG. 4 *a*). The filter member 2 is detachably attached to the housing 6 of the speaker unit 4. The holding member 16 encases the proximal end of the housing 6 and hereby the filter member 2 is detachably attached to the housing 6 of the speaker unit 4. The recess 24 provides free access to the tube 14.

The filter member 2 covers the first microphone or ventilation opening 10 as well as the second microphone or ventilation opening 12 in the housing 6 of the speaker unit 4. However, a portion of the housing 6 is not covered by the filter member 2.

The illustrated holding member 16 provides an easy useable and highly reliable attachment tool that can be used to secure the filter member 2 to the housing 6 of the speaker unit 4.

Figure 5B:
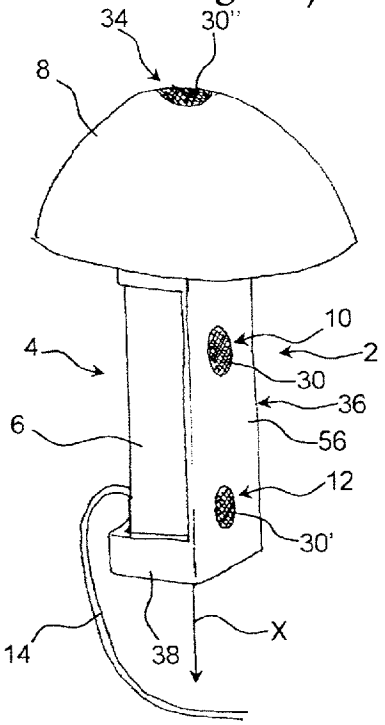
FIG. 5 *a*) shows a schematic perspective view of a filter member according to the invention attached to a speaker unit of a RITE hearing aid device and FIG. 5 *b*) shows a schematic perspective view of another filter member according to the invention attached to a speaker unit of a RITE hearing aid device.
Figure 5A:
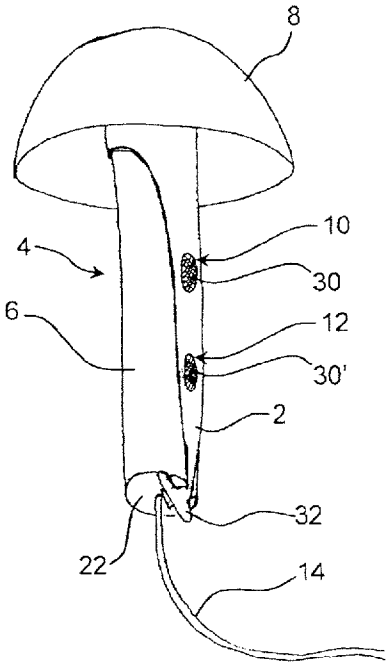

FIG. 5 *a*) illustrates a schematically perspective view of a filter member 2 according to the invention attached to the speaker unit 4 of a RITE hearing aid device.

The speaker unit 4 has a cylindrical housing 6 with a plane circular bottom surface 22, a first microphone or ventilation opening 10 and a second microphone or ventilation opening 12. A dome 8 is attached to the distal end of the housing 6 of the speaker unit 4. A tube 14 enters the speaker unit 4 through a hole in the bottom surface 22 of the housing 6.

A filter member 2 is detachably attached to the distal portion of the housing 6 (under the dome) and to the proximal end of the housing 6 by means of an attachment member 32 that is fixed to the bottom surface 22 of the housing 6. The filter member 2 comprises a first lattice 30 covering the first microphone or ventilation opening 10 of the housing 6 and a second lattice 30' covering the second microphone or ventilation opening 12. The filter member 2 also comprises a lattice (not shown) that covers an opening (not shown) in the distal end of the housing 6. It is possible to apply a fine mesh to cover e.g. the microphone or ventilation openings 10, 12 and to use a big-meshed lattice to cover the lattice that covers an opening in the distal end of the housing 6.

FIG. 5 *b*) illustrates a schematically perspective view of another filter member 2 according to the invention attached to a speaker unit 4 of a RITE hearing aid device. The filter member 2 comprises a cover 56. The speaker unit 4 comprises a housing 6 to which a dome 8 is attached. The dome 8 comprises a sound outlet 34 covered by a lattice 30" that is part of the filter member 2.

The cover 56 has a basically plane rectangular base member 36 that extends along the longitudinal axis X of the housing 6. The cover 56 has an end member 38 that encases the proximal end of the housing 6 and hereby is attached to the housing 6.

The filter member 2 comprises a first lattice 30 covering a first microphone or ventilation opening 10 of the housing 6 and a second lattice 30' covering a second microphone or ventilation opening 12. The filter member 2 also comprises a lattice 30" that is visible through the sound outlet 34 in the dome 8. The lattice 30" covers an opening (not shown) in the distal end of the housing 6, through which opening sound waves are transferred further out through the sound outlet 34 in the dome 8.

The cover member 56 may be produced in a flexible material such as silicone so that the cover member 56 has a flexibility that makes it possible to attach the cover member 56 to the housing 6 and detached the cover member 56 from the housing 6.

The filter member 2 may be shaped as a one-piece body formed as a lattice. The filter member 2 may comprise several sections having different characteristics (e.g. one section having a big-meshed lattice and another section comprising a fine mesh lattice). The filter member 2 may be replaced on a daily basis so that accumulation of ear wax can be prevented. In this way it is possible to maintain a well-functioning hearing aid device.

The filter member may comprise a flexible woven, knitted or felted material consisting of a network of artificial fibres or natural fibres. The fibres may comprise be any suitable type of thread or yarn.

LIST OF REFERENCE NUMERALS

2—Filter member
4—In-the-ear (ITE) hearing aid device, speaker unit or in-the-canal hearing aid device.
6—Housing
8—Dome
9—First microphone

10—Microphone or ventilation opening
11—Second microphone
12—Microphone or ventilation opening
14—Tube
16—Holding member
18—Gripping member
20—Recess
22—Bottom surface
24—Aperture
26—Bottom member
28—Side member
30, 30', 30"—Lattice
32—Attachment member
34—Sound outlet
36—Base member
38—End member
40, 40'—Finger
42—Distal end
44—Open end
46—Closed end
48—Proximal end
50, 50'—Leg
52—First structure
54—Second structure
56—Cover member
X—Longitudinal axis

The invention claimed is:

1. A replaceable filter member for a hearing aid device, the hearing aid device comprising a unit with a housing configured to be inserted into the ear canal of a user of the hearing aid device, which filter member is configured to prevent ear wax from entering openings in the housing, when mounted on the housing, the filter member extends along the length of the housing and covers a distal end of the housing, the housing comprising a sound opening at the distal end of the housing, and the housing further comprises one or more openings along the length of the housing, the filter member comprises a first lattice of a first structure and a second lattice of a second structure being a different structure than the first lattice structure, the second lattice covers the sound opening at the distal end of the housing when the filter member is attached to the unit, and the first lattice covers the one or more openings along the length of the housing when the filter member is attached to the unit.

2. A filter member according to claim 1, wherein the filter member comprises a one-piece body that is configured to cover all openings in the unit while the filter member is attached to the unit.

3. A filter member according to claim 1, wherein the filter member comprises a sock-like member configured to be attached to the housing.

4. A filter member according to claim 1, wherein the filter member comprises a flexible member.

5. A filter member according to claim 4, wherein the flexible member is configured to allow for attachment of the filter member to the unit and to allow for detachment of the filter member from the unit.

6. A filter member according to claim 1, wherein the filter member comprises an attachment member or a holding member configured to be attached to the housing and hereby provide a detachable attachment of the filter member to the unit.

7. A filter member according to claim 6, wherein the attachment member or the holding member comprises a ring that is configured to surround, at least, a portion of the housing of the unit.

8. A filter member according to claim 6, wherein the attachment member or the holding member is configured to be attached to the proximal end of the housing and hereby provide a detachable attachment of the filter member to the unit.

9. A filter member according to claim 1, wherein the filter member comprises a cover member configured to be attached to the housing and hereby provide a detachably attachment of the filter member to the unit.

10. A filter member according to claim 9, wherein the cover member comprises a base member that extends essentially parallel to the longitudinal axis of the housing and that one or more openings are provided in the base member so that the openings allow for sound propagation or ventilation through the openings.

11. A filter member according to claim 1, wherein the first lattice is a fine mesh lattice and the second lattice is coarser mesh lattice than the first lattice.

12. A filter member according to claim 1, wherein the filter member has a closed end and an open end and that means for attaching the filter member to the housing is attached to the open end of the filter member.

13. A filter member according to claim 1, wherein the filter member is configured to be attached to means for attaching the filter member to the housing so that the means for attaching the filter member to the housing can be reused when the filter member is replaced by a new one.

14. A hearing aid device comprising:

a housing of a speaker unit configured to be positioned in the ear canal of a user, the housing having a distal end configured to be positioned near the ear drum of the user and a proximal end to be positioned near the opening of the ear canal, a detachable filter member configured to be mounted on the housing, which filter member is configured to prevent ear wax from entering openings in the housing, when mounted on the housing, the filter member extends along the length of the housing and covers a distal end of the housing, the housing comprising a sound opening at the distal end of the housing, and the housing further comprises one or more openings along the length of the housing, the filter member comprises a first lattice of a first structure and a second lattice of a second structure being a different structure than the first lattice structure, the second lattice covers the sound opening at the distal end of the housing when the filter member is attached to the unit, and the first lattice covers the one or more openings along the length of the housing when the filter member is attached to the unit.

15. A hearing aid device according to claim 14, wherein the hearing aid is a receiver-in-the-ear type hearing aid or an in-the-canal type hearing aid.

* * * * *